US010697107B2

(12) United States Patent
Kim

(10) Patent No.: US 10,697,107 B2
(45) Date of Patent: Jun. 30, 2020

(54) CLOTHING PROCESSING APPARATUS AND CONTROL METHOD OF CLOTHING PROCESSING APPARATUS

(71) Applicant: LG ELECTRONICS INC., Seoul (KR)

(72) Inventor: Keunjoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 97 days.

(21) Appl. No.: 15/553,413

(22) PCT Filed: Mar. 23, 2016

(86) PCT No.: PCT/KR2016/002923
§ 371 (c)(1),
(2) Date: Aug. 24, 2017

(87) PCT Pub. No.: WO2016/159561
PCT Pub. Date: Oct. 6, 2016

(65) Prior Publication Data

US 2018/0112343 A1 Apr. 26, 2018

(30) Foreign Application Priority Data

Apr. 1, 2015 (KR) ..... 10-2015-0046053

(51) Int. Cl.
*D06F 37/22* (2006.01)
*D06F 37/20* (2006.01)
(Continued)

(52) U.S. Cl.
CPC ..... *D06F 37/225* (2013.01); *D06F 33/00* (2013.01); *D06F 37/20* (2013.01); *D06F 37/22* (2013.01);
(Continued)

(58) Field of Classification Search
CPC ..... D06F 37/225
See application file for complete search history.

(56) References Cited

U.S. PATENT DOCUMENTS

2002/0088502 A1* 7/2002 Van Rompuy ..... A47L 15/006 141/1
2012/0144598 A1* 6/2012 Ostdiek ..... D06F 37/06 8/137
(Continued)

FOREIGN PATENT DOCUMENTS

KR 10-1995-0018902 7/1995
KR 20-0155392 9/1999
(Continued)

OTHER PUBLICATIONS

International Search Report and Written Opinion dated Jul. 1, 2016 issued in Application No. PCT/KR2016/002923 (with English translation).

*Primary Examiner* — Jason Y Ko
(74) *Attorney, Agent, or Firm* — KED & Associates LLP

(57) ABSTRACT

The present invention relates to a clothing processing apparatus comprising: a drum which provides a space for storing clothing therein; a driving part which rotates the drum; a storage part, which is fixed on at least one surface of the front surface of the drum and the rear surface of the drum and provides a space for storing liquid therein; a plurality of balancers which are fixed on the circumferential surface of the drum and provide a space for storing liquid therein; a plurality of flow paths which connect the storage part and each of the balancers; and a plurality of valves which open and close each of the flow paths.

9 Claims, 4 Drawing Sheets

(51) Int. Cl.

| | |
|---|---|
| ***D06F 33/00*** | (2020.01) |
| ***D06F 37/26*** | (2006.01) |
| ***D06F 37/30*** | (2020.01) |

(52) U.S. Cl.

CPC ..... *D06F 37/266* (2013.01); *D06F 37/304* (2013.01); *D06F 2202/065* (2013.01); *D06F 2204/065* (2013.01); *D06F 2204/10* (2013.01); *D06F 2220/00* (2013.01); *D06F 2222/00* (2013.01)

(56) References Cited

U.S. PATENT DOCUMENTS

| | | | | |
|---|---|---|---|---|
| 2012/0144881 | A1* | 6/2012 | Farid ..... | D06F 37/225 68/200 |
| 2014/0223969 | A1 | 8/2014 | Kim et al. | |

FOREIGN PATENT DOCUMENTS

| | | |
|---|---|---|
| KR | 10-0785386 | 12/2007 |
| KR | 10-2013-0077981 | 7/2013 |
| KR | 10-2014-0102014 | 8/2014 |

* cited by examiner (a)

(b)

CLOTHING PROCESSING APPARATUS AND CONTROL METHOD OF CLOTHING PROCESSING APPARATUS

CROSS-REFERENCE TO RELATED PATENT APPLICATIONS

This application is a U.S. National Stage Application under 35 U.S.C. § 371 of PCT Application No. PCT/KR2016/002923, filed Mar. 23, 2016, which claims priority to Korean Patent Application No. 10-2015-0046053, filed Apr. 1, 2015, whose entire disclosures are hereby incorporated by reference.

FIELD

Embodiments of the present invention relate to clothing processing apparatus (a laundry treating apparatus) and control method of clothing processing apparatus (a control method of a laundry treating apparatus).

BACKGROUND

A conventional laundry treating apparatus includes a cabinet defining an exterior appearance, a tub mounted in the cabinet, a drum rotatably oriented in the tub to wash laundry and a motor fixed to the drum to rotate the drum, with a shaft penetrating the tub.

The drum is likely to fail in keeping dynamic equilibrium or dynamic balance according to the location of the laundry loaded in the drum, while rotating the laundry.

The term of dynamic equilibrium or dynamic balance means a status where a centrifugal force or a moment created by a centrifugal force becomes "0" (zero) with respect to a shaft while a rotating body is rotating. If mass distribution of a rigid body is uniform with respect to a shaft, it can be said that dynamic equilibrium or dynamic balance is maintained.

When applied to such a laundry treating apparatus, a dynamic equilibrium state or a dynamic-balanced state can be understood as a state where mass distribution of laundry with respect to the shaft of the drum is within a permissible range while the drum accommodating laundry is rotating.

In contrast, a dynamic-unbalanced state of the laundry treating apparatus can be understood as a state where mass distribution of laundry with respect to the shaft of the rotating drum is not uniform. In the laundry treating apparatus, the dynamic-unbalanced state occurs when the laundry is not distributed uniformly.

The rotating drum in the dynamic-unbalanced state is also vibrating and the vibration of the rotating drum is delivered to the tub or the cabinet, such that the vibration may cause a disadvantage of noise.

Some of the conventional laundry treating apparatuses include balancing units for compensating the unbalance of the drum. Such balancing units provided in the conventional laundry treating apparatuses are provided as ball balancers or fluid balancer having balls or liquid provided in a housing fixed to the drum.

The dynamic-unbalanced drum has the highest rotation speed when the laundry as an unbalance inducing factor is passing the lowest point of a drum rotation locus and the lowest rotation speed when the laundry as the unbalance inducing factor is passing the highest point of the drum rotation locus.

Accordingly, the ball balancer or fluid balancer provided in the conventional laundry treating apparatus controls unbalance by implementing the ball or fluid to move toward the lowest point of the drum rotation locus when the laundry as the unbalance inducing factor is moving toward the highest point.

However, it is difficult to solve the dynamic balance of the drum immediately (or to settle the dynamic balance actively), using the structure of such the balancer mentioned above.

DETAILED DESCRIPTION OF THE INVENTION

Technical Problem

To overcome the disadvantages, an object of the present disclosure is to provide a laundry treating apparatus which may actively settle unbalanced rotation or dynamic unbalance (in other words, unbalance) of a drum accommodating laundry, and a control method for the same.

Another object of the present disclosure is to provide a laundry treating apparatus which may such dynamic unbalance of the drum by supplying fluid to the means configured to agitate the laundry loaded in the drum, and a control method for the same.

Technical Solution

To achieve these objects and other advantages and in accordance with the purpose of the embodiments, as embodied and broadly described herein, a laundry treating apparatus includes a drum comprising a rear surface, a front surface and a circumferential surface connecting the front surface with the rear surface, and providing a space in which clothes are held; a driving unit rotating the drum; a fluid storage fixed to one or more of the front surface and front surface and defining an internal space in which the fluid is stored; a plurality of balancers fixed to the circumferential surface and defining a space in which the fluid is stored; a plurality of flow paths connecting the fluid storage with the balancers, respectively; and a plurality of valves opening and closing the plurality of the flow paths, respectively.

The plurality of the balancers may include four or more balancers, and the balancers may be distant a preset angle with respect to a center of the drum from each other.

The plurality of the balancers may include a first balancer, a second balancer and a third balancer which are distant a preset angle from each other, and the plurality of the flow paths may include a first flow path connecting the first balancer with the fluid storage, a second flow path connecting the second balancer with the fluid storage and a third flow path connecting the third balancer with the fluid storage, and the plurality of the valves may include a first valve opening/closing the first flow path, a second valve opening/closing the second flow path and a third valve opening/closing the third flow path.

Each of the balancers may further include an inclined surface for moving the fluid stored therein along a direction in which each corresponding flow path is arranged.

The first balancer may further include a first inclined surface for moving the fluid stored in the first balancer toward the first flow path, and the second balancer may further include a second inclined surface for moving the fluid stored in the second balancer toward the second flow path, and the third balancer may further include a third inclined surface for moving the fluid stored in the third balancer toward the third flow path.

The laundry treating apparatus may further include a first return-flow path moving the fluid inside the first balancer to the fluid storage and shutting off the fluid inside the fluid storage to the first balancer; a second return-flow path moving the fluid inside the second balancer to the fluid storage and shutting off the fluid inside the fluid storage to the second balancer; and a third return-flow path moving the fluid inside the third balancer to the fluid storage and shutting off the fluid inside the fluid storage to the third balancer.

The first return-flow path may move the fluid inside the first balancer to the fluid storage, when the drum is rotated at a lower rotation number than a preset reference rotation number, and the second return-flow path may move the fluid inside the second balancer to the fluid storage, when the drum is rotated at a lower rotation number than a preset reference rotation number, and the third return-flow path may move the fluid inside the third balancer to the fluid storage, when the drum is rotated at a lower rotation number than a preset reference rotation number.

The laundry treating apparatus may further include a power generation unit converting a kinetic energy of the drum into an electrical energy; a charging unit storing the electrical energy generated in the power generation unit or supplying the electrical energy to each of the valves; and a controller controlling the valves and the driving unit.

The laundry treating apparatus may further include a sensing unit determining a location of clothes inducing a unbalance of the drum; a controller controlling the valves to allow the fluid supplied to the balancer located in an area of an overall drum area formed by the circumferential surface of the drum so as to increase the weight of the area symmetrically corresponding to the location of the unbalance inducing clothes.

In another aspect of the present disclosure, a control method for a laundry treating apparatus including a drum in which clothes are held; a driving unit rotating the drum; a fluid storage fixed to one or more of front surface and a rear surface of the drum and defining an internal space in which the fluid is stored; a plurality of balancers fixed to the drum, in a state of being located between the front surface and the rear surface, and defining a space in which the fluid is stored; a plurality of flow paths connecting the fluid storage to the balancers, respectively; a plurality of valves opening/closing the flow paths, respectively; and a sensing unit determining a location of clothes inducing a unbalance of the drum, the control method includes a sensing step of determining an area in which the unbalance inducing clothes are located out of a circumferential surface of the drum by controlling the sensing unit; a rotating step of rotating the drum at a higher rotation speed that a preset reference rotation number; a controlling step of supplying the fluid to one or more of the balancers so as to increase a weight of an area symmetrically corresponding to the location of the unbalance inducing clothes.

The reference rotation number may be set as a rotation number at which a centrifugal force generated by the rotation of the drum moves the fluid inside the fluid storage to each of the balancers.

The control method may further include a returning step of returning the fluid stored in each of the balancers to the fluid storage by means of the weight of the fluid by controlling each of the valves.

The returning step may include rotating the drum at a lower rotation number than the reference rotation number; and controlling the valves to open all of the flow paths.

The returning step may include rotating the drum at a lower rotation number than the reference rotation number; and sequentially controlling the valves to return the fluid inside one of the balancers, located over a horizontal line passing the center of the drum, to the fluid storage by means of the weight of the balancer.

Advantageous Effects

According to at least one of the embodiments of the present disclosure, a laundry treating apparatus which can actively settle unbalanced rotation or dynamic unbalance (in other words, unbalance) of a drum accommodating laundry, and a control method for the same may be provided.

A laundry treating apparatus which may such dynamic unbalance of the drum by supplying fluid to the means configured to agitate the laundry loaded in the drum, and a control method for the same may be provided. Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Figure 1:
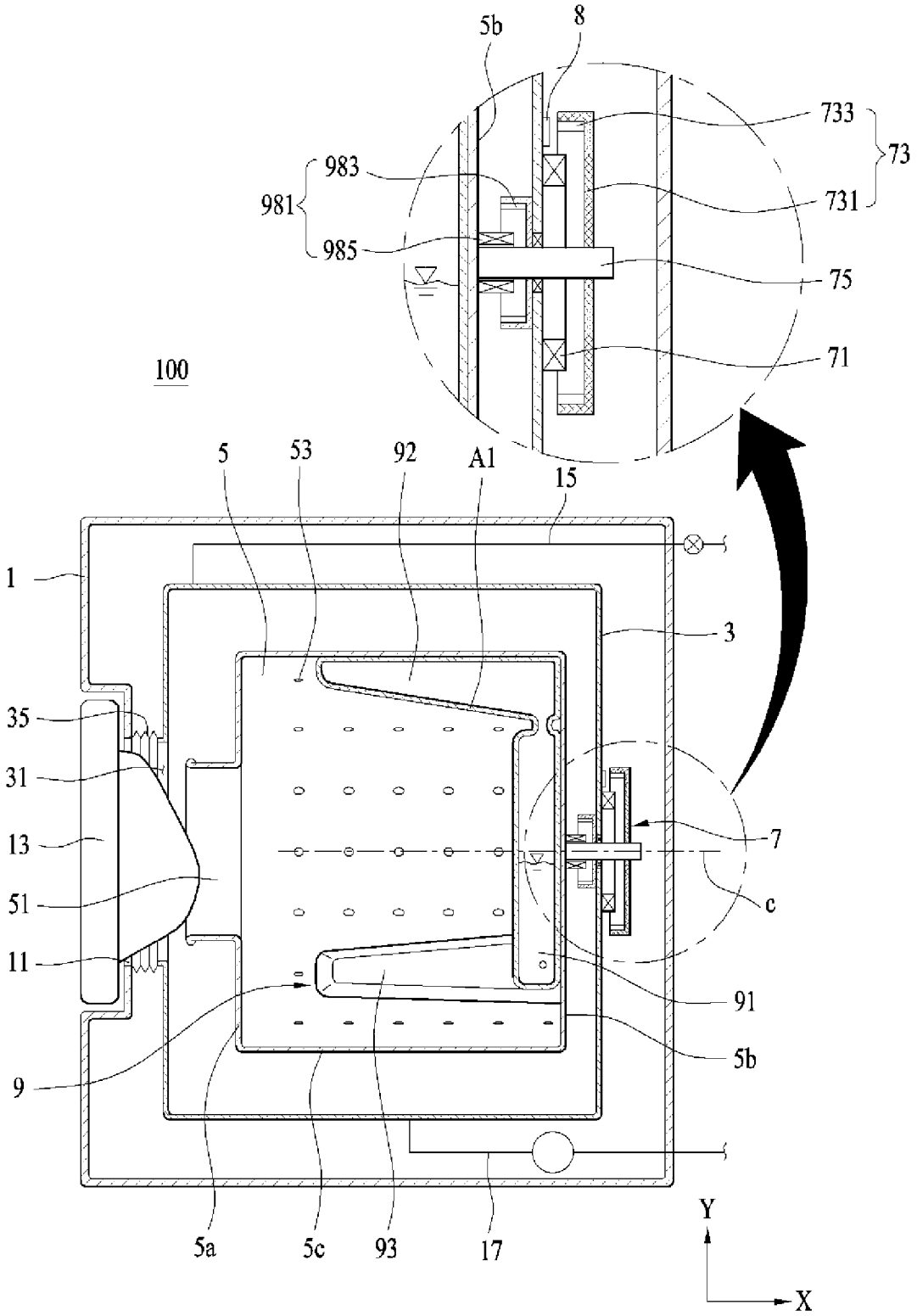
FIG. 1 is a diagram illustrating one embodiment of a laundry treating apparatus in accordance with the present disclosure.

As shown in FIG. 1, a laundry treating apparatus 100 in accordance with one embodiment of the present disclosure includes a cabinet 1, a tub 3 provided in the cabinet and configured to hold wash water, a drum 5 rotatably provided in the tub and configured to accommodate laundry, and a driving unit 7 configured to rotate the drum 5.

The cabinet 1 may include an opening 11 for loading clothes to wash, in other words, laundry and a door 13 for closing the opening 11.

In this instance, a tub opening 31 has to be provided in a front surface of the tub and the tub opening 31 is in communication with the opening 11. A drum opening 51 has to be provided in a front surface 5*a* of the drum 5 and the drum opening 51 is in communication with the opening 11 and the tub opening 31.

A gasket 35 is provided between the opening 11 and the tub opening 31 and functioned to prevent the wash water held in the tub from leaking outside the tub. When the gasket 35 is made of a flexible material such as rubber, the vibration generated in the tub may be prevented from being delivered to the cabinet 1.

In the cabinet 1 may be provided a water inlet unit 15 for supplying wash water to the tub and a water outlet unit 17 for discharging the wash water held in the tub outside the cabinet.

The drum 5 may have a cylindrical shape and a plurality of penetrating holes 53 may be provided in the drum 5. The wash water held in the tub may be supplied to the clothes or laundry provided in the drum 5.

The driving unit 7 may be provided in any types only if rotating the drum 5. FIG. 1 illustrates one embodiment in which the driving unit 7 is configured with a stator 71 and a stator 71 which are arranged in an outer surface of the tub 3 and a shaft 75 connecting the rotor 73 to a rear surface 5*b* of the drum 5 through the tub.

The stator 71 serves as means for forming a rotating field and the rotor 73 serves as means for rotating the shaft 75 by means of the rotating field provided by the stator. For that, the rotor 73 includes a rotor body 731 to which the shaft is secured and a plurality of permanent magnets fixed to the rotor body 731 to expose magnetic poles alternatively.

When the laundry is concentrated in a certain area of the drum 5, dynamic unbalance (hereinafter, unbalance) may be generated in the rotating drum of the laundry treating apparatus having the structure mentioned above. The term of unbalance (or dynamic unbalance) means a state where dynamic balance of the drum 5 is collapsed. The dynamic balance of the laundry treating apparatus may be understood as a state mass distribution of laundry with respect to the shaft of the drum 5 is within a permissible range when the drum 5 accommodating the is rotating. Accordingly, the dynamic-unbalance state (unbalance) of the laundry treating apparatus may be understood as the state where mass distribution with respect to the shaft of the rotating drum is not uniform.

The drum 5 rotating in the unbalance state generates vibration and the vibration is delivered to the tub or cabinet only to cause noise. To prevent such a problem of noise, the illustrated embodiment of the laundry treating apparatus 100 includes a sensing unit 8 for determining presence of unbalance, a location of a force inducing the unbalance (a location of clothes inducing the unbalance) and a balancing unit 9 for decreasing the force inducing the unbalance.

The sensing 8*nit* 8 may be provided as any types only configured to determine whether the drum 5 is in the unbalance state. FIG. 1 illustrates one sensor which may determine the presence of the unbalance and the location of the force inducing the unbalance by sensing the rotation number of the rotor 73 as one example of the sensing unit.

When the laundry as an unbalance inducing factor is passing the lowest point of the drum rotation locus within the drum rotating in the unbalanced state in the laundry treating apparatus, with the shaft parallel with the ground, the rotation speed of the drum 5 is the highest. When the laundry as the unbalance inducing factor is passing the highest point of the drum rotation locus, the rotation speed of the drum 5 is the lowest.

The sensing unit 8 may be provided as a sensor implemented to sense the rotation speed of the rotor 73 and then a controller (not shown) may be implemented to determine whether a variation range between the maximum and the minimum value of the signal transmitted by the sensing unit 8 is a reference variation or more and only to determine whether the rotating drum is in the unbalanced state based on the result of the determination. The controller may determine that the laundry inducing the unbalance is located in the area where the maximum value of the signal transmitted by the sensing unit 8 is sensed.

Examples of the sensing unit 8 serving the function mentioned above may include a Hall Effect sensor implemented to sense the rotation speed of the rotor by sensing a magnetic force of the permanent magnets provided in the rotor.

The balancing unit 9 provided in the illustrating embodiment of the present disclosure is the means for decreasing the unbalance by temporarily increasing a weight of a certain area possessed by a circumferential surface 5*c* of the drum 5. The balancing unit 9 may include a fluid storage 91 in which fluid is stored, a flow path 921, 931 and 941 for connecting the storage to the balancer and a valve 923, 933 and 943 for opening and closing the flow path.

The fluid storage 91 is provided as the means for storing the fluid which will be supplied to a plurality of balancers 92, 93 and 94 and it may be fixed to one or more of the front and rear surfaces 51 and 5*b* of the drum 5.

When fixed to the rear surface 5*b* of the drum 5 as illustrated in FIG. 1, the fluid storage 91 may be provided in a cylinder shape. However, when fixed to the front surface 5*a* of the drum 5, the fluid storage 91 may be provided in a ring shape not to interfere in the drum opening 51.

Meanwhile, two or more of the balancers provided in the balancing unit 9 are spaced apart a preset angle from each other, while defining an internal storage space for the fluid. If only one balancer is provided in the drum 5, the weight of the fluid supplied to the one balancer may cause the unbalance of the drum 5.

Specifically, if two balancers are provided in the balancing unit 9, a first balancer and the second balancer have to be fixed to the circumferential surface 5*c* of the drum 5, distant 180 degrees from each other. If three balancers are provided in the balancing unit 9, the three balancers have to be fixed to the circumferential surface of the drum 5, distant 120 degrees from each other. In case of four balancers, they have to be fixed to the circumferential surface of the drum 5, distant 90 degrees from each other.

Figure 2:
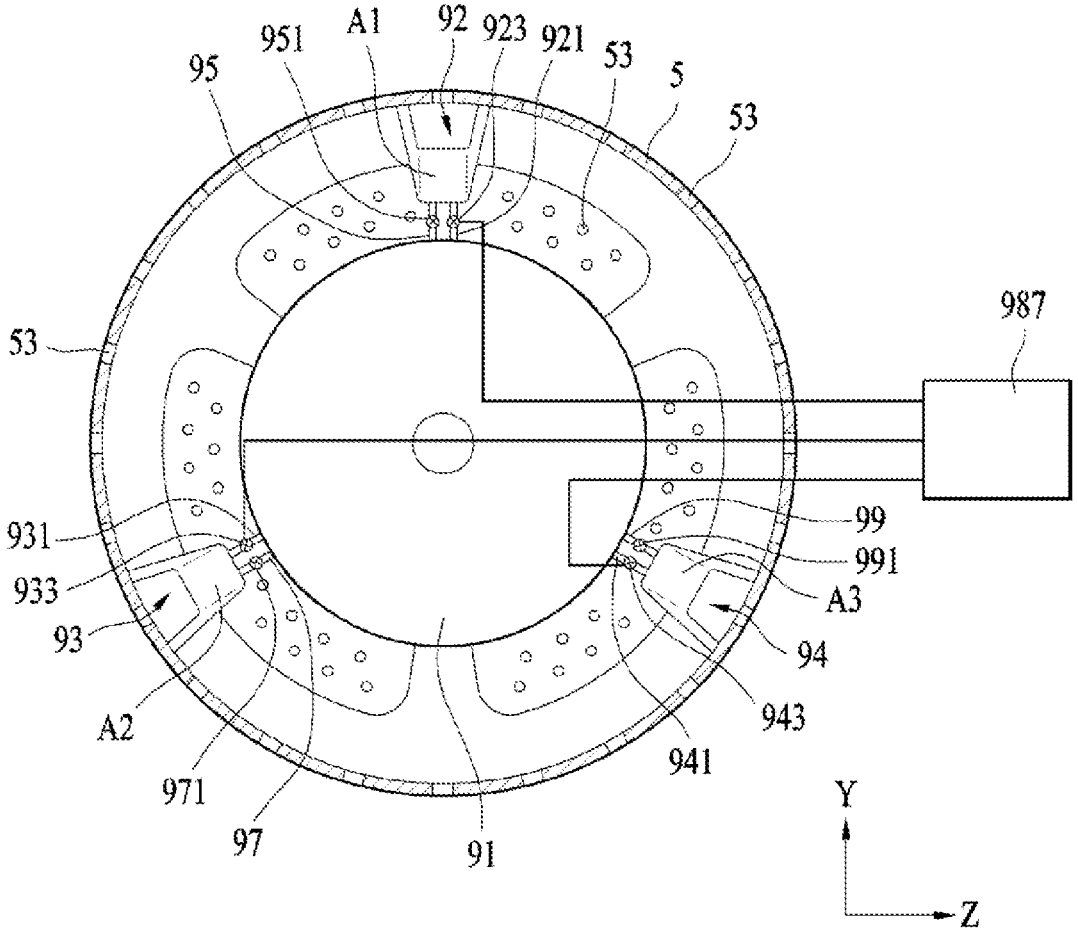
FIG. 2 is a diagram illustrating one embodiment of a balancing unit provided in the laundry treating apparatus.

FIG. 2 illustrates one example of the balancing unit 9 including three balancers 92, 93 and 94. Hereinafter, the balancing unit 9 including a first balancer 92, a second balancer 93 and the third balancer 94 will be applied to the embodiments of the laundry treating apparatus to make the present disclosure understood and described easily and conveniently.

The first balancer 92 may be provided in a bar shape extended toward the front surface 5*c* from the rear surface 5*b* of the drum 5 (or along a longitudinal direction of the drum 5 (X-axis direction)).

An internal space is formed in the first balancer 92 and the fluid is stored in the internal space. The internal space of the first balancer 92 is connected to the fluid storage 91 via a first flow path 921. A first valve 923 is provided in the first flow path to open and close the first flow path according to a control signal of the controller (not shown).

Meanwhile, a first inclined surface (A1) may be provided in the first balancer 92 to collect the fluid supplied to the first balancer 92 back to the fluid storage 91. Preferably, the first inclined surface (A1) is getting inclined up to the rear surface 5*b* from the front surface 5*a* of the drum 5.

In other words, the first inclined surface (A1) may be formed to guide the fluid inside the first balancer 92 toward the first valve 923, when the first balancer 91 is moved to an upper area from a horizontal line (C which is parallel with the ground, see FIG. 3) past the center of the drum rotation by the drum rotation.

The second balancer 93 and the third balancer 94 may have the same structure as the first balancer 92. Preferably, the second balancer 93 is connected to the fluid storage 91 via the second flow path 931 and the third balancer 94 is connected via the third flow path 941.

In this instance, a second valve 933 implemented to open and close the second flow path according to the control signal of the controller has to be provided in the second flow path 931 and a third valve 943 implemented to open and close the third flow path according to the control signal of the controller has to be provided in the third flow path 941.

A second inclined (A2) may be provided in the second balancer 93 to guide the fluid stored in the internal space of the second balancer toward the second flow path 931 when the second balancer is moved to an upper area over the horizontal line (C). A third inclined surface (A3) may be provided in the third balancer 94 to guide the fluid stored in the internal space of the third balancer toward the third flow path 941, when the third balancer is moved to an upper area over the horizontal line (C).

The first valve 923, the second valve 933 and the third valve 943 provided to open and close the flow paths, respectively, may be provided with the electric power by a power supply unit 981 and 987. The power supply unit may include a power generation unit 981 configured to covert a kinetic energy of the drum 5 to an electrical energy and a charging unit 987 configured to store and supply the electrical energy of the power generation unit 981 to the valves.

The power generation unit 981 may include a permanent magnet 983 fixed to a rear surface of the tub and a coil 985 fixed to the rear surface 5*b* of the drum 5 to rotate in a line of the magnetic force provided by the permanent magnet.

The electrical energy stored in the charging portion 987 is supplied to each of the valves 923, 933 and 943. The valves 923, 933 and 943 are controlled to open the flow paths 921, 931 and 941 according to the control signal of the controller (not shown), respectively. Meanwhile, the controller and the valves 923, 933 and 943 can communicate with each other wirelessly.

Next, referring to FIG. 3, the operation of the balancing unit 9 having the structure mentioned above will be described.

Once determining that the drum 5 is rotating in the unbalanced state, the controller is implemented to supply the fluid to one or more of the balancers 92, 93 and 94 so as to locally increase the weight of the drum located in a certain area symmetrically corresponding to the location of the clothes inducing the unbalance.

The drum 5 is rotating at a rotation number (a reference rotation number) where the fluid stored in the storage 91 is moved to the balancers 92, 93 and 94 by the centrifugal force generated by the rotating drum 5. After that, the fluid inside the storage 91 is guided toward an edge area of the fluid storage 91 by the centrifugal force generated by the rotation of the drum.

Meanwhile, the rotation speed of the drum rotating in the unbalanced state when the clothes (UB) inducing the unbalance is passing the lowest point of the drum rotation locus is different from the rotation speed when the clothes (UB) are passing the highest point of the drum rotation locus. Accordingly, the fluid (W) inside the fluid storage 91 shall move toward the point symmetrically corresponding to the location of the clothes (UB) inducing the unbalance when the drum 5 is passing the highest point of the drum rotation locus. The balancing unit 9 provided in the illustrated embodiment is able to settle the unbalance, even without supplying the fluid inside the fluid storage 91 to the balancers 92, 93 and 94 to some degree.

However, when the fluid inside the fluid storage 91 is supplied to the balancers 92, 93 and 94, the unbalance of the drum 5 can be settled more quickly and even completely. The controller (not shown) is implemented to supply the fluid to the balancers 92, 93 and 94 so as to increase the weight of the drum area symmetrically corresponding to the drum area where the clothes (UB) inducing the unbalance is located.

In other words, while the drum 5 is rotating at the reference rotation number, the controller control the centrifugal force activating the fluid supplied to one or more of the balancers or a resultant force of the centrifugal force to cancel the centrifugal force (F_UB) activating in the unbalance inducing clothes (UB) by controlling the valves 923, 933 and 943.

Figure 3:
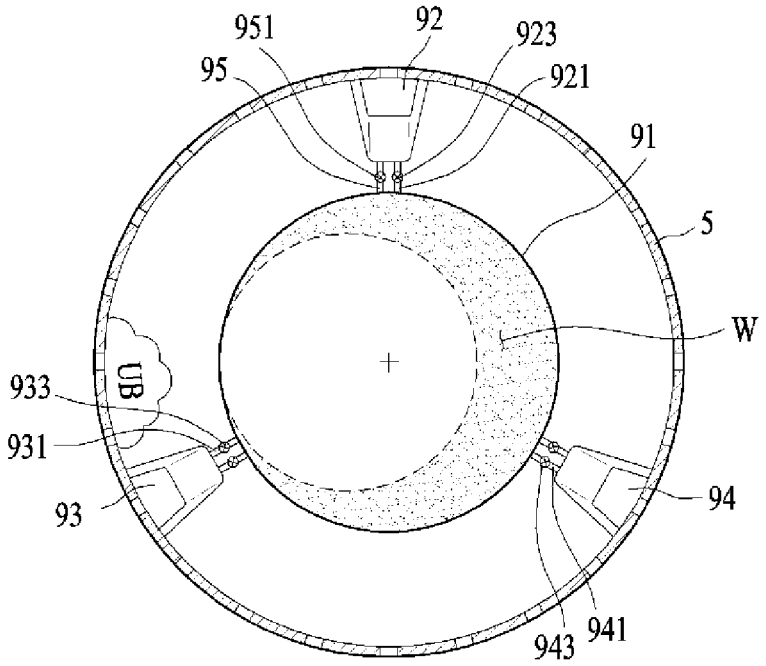
FIG. 3 is a diagram illustrating an operation of the balancing unit.
Figure 3:
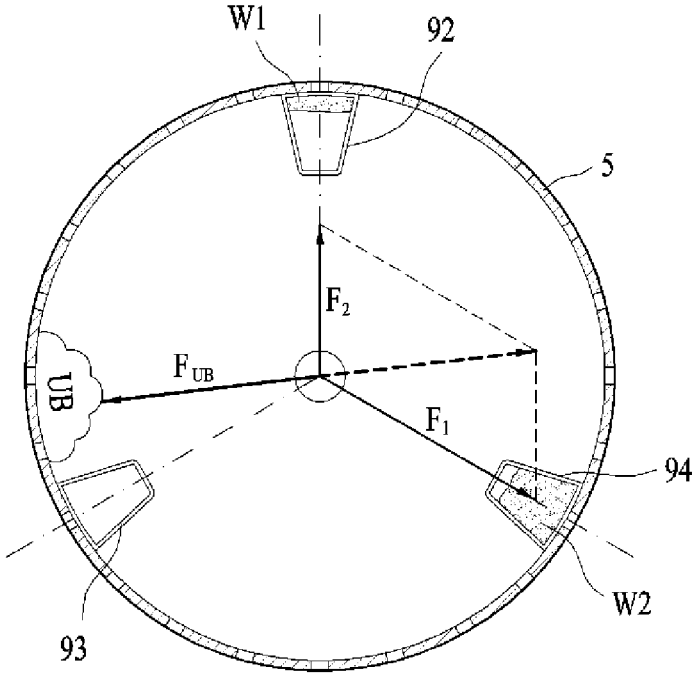

FIG. 3(*b*) illustrates that the unbalance inducing clothes (UB) are concentrated on a certain area adjacent to the second balancer 93. The controller is implemented to supply the fluid to the first balancer 92 and the third balancer 94 by controlling the first valve 923 and the third valve 943. In this instance, the controller controls the operation time of the first valve 923 to be different from the operation time of the third valve 943 such that the amount (W2) of the fluid supplied to the third balancer 94 may be larger than the amount (W1) of the fluid supplied to the first balancer 92.

The amount of the fluid supplied to the first balancer 92 and the amount of the fluid supplied to the third balancer 94 have to be determined so as to correspond the resultant force (F) of the centrifugal forces (F2) and (F1) activating in the fluids supplied to the first balancer and the third balancer with the centrifugal force (F_UB) activating in the unbalance inducing clothes. The controller can estimate the amount of the fluid supplied to the first balancer 91 and the amount of the fluid supplied to the third balancer 94 by controlling the operation time periods of the first valve 923 and the third valve 943.

After the unbalance of the drum 5 is settled through the processes mentioned above, the drum 5 performs preset cycles and the fluid stored in the first balancer 92 and the third balancer 94 has to be returned to the fluid storage 91. Otherwise, the fluid stored in the first balancer and the third balancer might induce the unbalance when the drum 5 is rotating again.

For that, the controller controls the first valve 923 and the third valve 943 to open the first flow path 921 and the third flow path 943, while controlling the drum 5 to rotate below the reference rotation number.

When the drum 5 is rotating below the reference rotation number in a state where the first flow path 921 and the third flow path 943 are opened by the first valve 923 and the third valve, the fluid stored in the balancers will be returned to the fluid storage 91 by the first inclined surface (A1) and the third inclined surface (A3).

As an alternative example, the fluid stored in the balancers may be collected back in the fluid storage 91 in method which will be described hereinafter to minimize consumption of the electrical energy stored in the charging unit 987.

Specifically, the controller may control the fluid inside the first balancer to be returned to the fluid storage by opening the first valve 923, when the first balancer 92 is located in an upper area over the horizontal line (C) passing the center of the drum rotation. The controller may control the fluid inside the third balancer to be returned to the fluid storage by opening the third valve 943, when the third balancer 94 is located in an upper area over the horizontal line (C).

The balancing unit 9 provided in the embodiment of the laundry treating apparatus may further include a return-flow path configured to block the fluid inside the fluid storage 91 from flowing to the balancers 92, 93 and 94, while flowing the fluid inside the balancers 92, 93 and 94 to the fluid storage 91.

As illustrated in FIG. 2, the return-flow path may include a first return-flow path 95 connecting the first balancer 92 with the fluid storage 91, a second return-flow path 97 connecting the second balancer 93 with the fluid storage 91 and a third return-flow path 99 connecting the third balancer 94 with the fluid storage 91.

In this instance, a first check valve 951 has to be provided in the first return-flow path 95 and is implemented to open the first return-flow path only when the fluid inside the first balancer 92 flows to the fluid storage 91. A second check valve 971 has to be provided in the second return-flow path 97 and implemented to open the second return-flow path only when the fluid inside the second balancer 93 flows to the fluid storage 91. A third check valve 991 has to be provided in the third return-flow path 99 and is implemented to open the third return-flow path only when the fluid inside the third balancer 94 flows to the fluid storage 91.

Even the balancing unit 9 including the return-flow path may allow the fluid stored in the balancers to the fluid storage only when the drum 5 is rotated at a certain rotation number which is lower than the reference rotation number. Accordingly, the consumption of the electrical energy stored in the charging unit 987 may be minimized.

Figure 4:
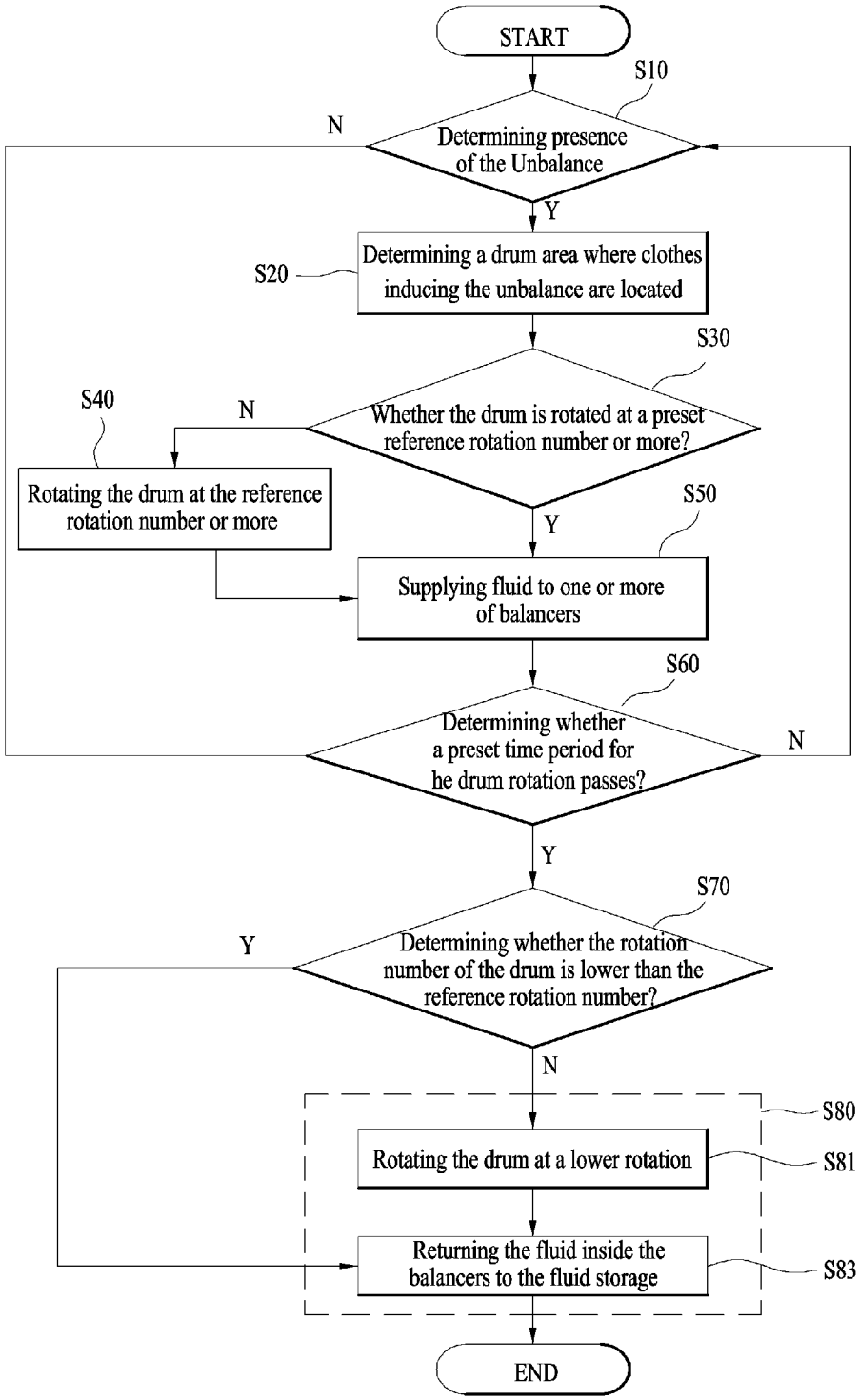
FIG. 4 is a diagram illustrating one embodiment of a control method for the laundry treating apparatus in accordance with the present disclosure.

FIG. 4 illustrates one embodiment of a control method for the laundry treating apparatus. Hereinafter, the embodiment of the control method will be descried.

The embodiment of the control method starts with a step (S10) of the controller determining presence of unbalance in the drum 5 based on the data transmitted by the sensing unit 8.

The controller may determine the presence of the unbalance generated in the drum 5 based on the result of determination whether a variation range from the minimum value and the maximum valve of the signals transmitted by the sensing unit 8.

Once determining that the unbalance is generated in the drum 5, the controller may perform a sensing step (S20) of determining a drum area of a circumferential surface of the drum 5 where the unbalance inducing clothes (UB) are located, using the sensing unit 8.

In the sensing step, the controller may determine that the unbalance inducing clothes are located in the area where the maximum valve of the signals transmitted by the sensing unit 8 is sensed.

When the location of the unbalance inducing clothes is determined in the sensing step, it is determined (S30) whether the drum 5 is rotated at the reference rotation number or more.

As mentioned above, the reference rotation number is set as a rotation number at which the fluid inside the fluid storage is moved to the balancers by the centrifugal force generated by the rotation of the drum 5.

When it is determined that the rotation number of the drum 5 is lower than the reference rotation number in the step (S30) of determining the rotation number of the drum 5, the embodiment of the control method in accordance with the present disclosure performs a rotating step (S40) of rotating the drum 5 at the preset reference rotation number or more.

While the drum 5 is rotated at the reference rotation number or more, the embodiment of the control method performs a controlling step (S50) of controlling the fluid to be supplied to one or more of the balancers so as to increase the weight of a certain drum area which is symmetrically corresponding to the drum area where the unbalance inducing clothes (UB) are located out of the overall drum circumferential surface area.

The controller may determine an area having a phase difference of 180 degrees (or 135~225 degrees) from the maximum value of the signals transmitted by the sensing unit 8 as the drum circumferential surface area symmetrically corresponding to the unbalance inducing clothes.

The controlling step (S50) is the step of supplying the fluid stored in the fluid storage 91 to one or more of the balancers 92, 93 and 94 by controlling the valves 923, 933 and 943. The unbalance of the drum 5 is decreased to a desired level in the controlling step (S50), the control method performs a step (S60) of determining whether a preset time period for the drum rotation passes.

The time period is preset before the step (S10) of determining presence of the unbalance and it may be set different according to the amount of the clothes loaded in the drum 5.

When determining that the preset time period passes, the embodiment of the control method determines whether the rotation number of the drum 5 is lower than the reference rotation number (S70) and then performs a returning step (S80) of returning the fluid stored in the balancers to the fluid storage. The returning step (S80) returns the fluid stored in the balancers to the fluid storage, using the weight of the fluid.

When the rotation number of the drum 5 is larger than the reference rotation number, the returning step (S80) performs a step (S81) of rotating the drum 5 at a lower rotation number than the reference rotation number and then a step (S83) of returning the fluid inside the balancers to the fluid storage by controlling the valves.

In this instance, the controller may return the fluid stored in the balancers to the fluid storage by opening all of the flow paths and rotating the drum 5 at the lower rotation number than the reference rotation number simultaneously.

The controller may return the fluid inside the balancers to the fluid storage by sequentially controlling the plurality of the valves to return the fluid stored in one balancer located over the horizontal line (C) passing the center of the drum rotation out of the balancers, using the weight of the fluid.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A laundry treating apparatus comprising:

a drum comprising a rear surface, a front surface and a circumferential surface connecting the front surface with the rear surface, and providing a space in which clothes are held;

a driving unit that rotates the drum;

a fluid storage fixed to the rear surface of the drum and defining an internal space in which the fluid is stored;

a plurality of balancers fixed to the circumferential surface, and each of the balancers having a separate internal space in which the fluid is stored;

a plurality of flow paths connecting the fluid storage with the space of the balancers, respectively; and a plurality of valves that open and close the plurality of the flow paths, respectively, wherein the internal space of each of the plurality of the balancers and the internal space of the fluid storage are configured to provide a closed flow path.

2. The laundry treating apparatus of claim 1, wherein the plurality of the balancers comprise four or more balancers, and the balancers are distant a preset angle with respect to a center of the drum from each other.

3. The laundry treating apparatus of claim 1, wherein the plurality of the balancers comprise a first balancer, a second balancer and a third balancer which are distant a preset angle from each other, and the plurality of the flow paths comprise a first flow path connecting the first balancer with the fluid storage, a second flow path connecting the second balancer with the fluid storage and a third flow path connecting the third balancer with the fluid storage, and the plurality of the valves comprise a first valve that opens/closes the first flow path, a second valve that opens/closes the second flow path and a third valve that opens/closes the third flow path.

4. The laundry treating apparatus of claim 1, wherein each of the balancers comprises an inclined surface for moving the fluid stored therein along a direction in which each corresponding flow path is arranged.

5. The laundry treating apparatus of claim 3, wherein the first balancer comprises a first inclined surface for moving the fluid stored in the first balancer toward the first flow path, and the second balancer comprises a second inclined surface for moving the fluid stored in the second balancer toward the second flow path, and the third balancer comprises a third inclined surface for moving the fluid stored in the third balancer toward the third flow path.

6. The laundry treating apparatus of claim 3, further comprising:

a first return-flow path that moves the fluid inside the first balancer to the fluid storage and that shuts off the fluid inside the fluid storage to the first balancer;

a second return-flow path that moves the fluid inside the second balancer to the fluid storage and that shuts off the fluid inside the fluid storage to the second balancer; and a third return-flow path that moves the fluid inside the third balancer to the fluid storage and that shuts off the fluid inside the fluid storage to the third balancer.

7. The laundry treating apparatus of claim 6, wherein the first return-flow path moves the fluid inside the first balancer to the fluid storage, when the drum is rotated at a lower rotation number than a preset reference rotation number, and the second return-flow path moves the fluid inside the second balancer to the fluid storage, when the drum is rotated at a lower rotation number than a preset reference rotation number, and the third return-flow path moves the fluid inside the third balancer to the fluid storage, when the drum is rotated at a lower rotation number than a preset reference rotation number.

8. The laundry treating apparatus of claim 1, further comprising:

a power generation unit that converts a kinetic energy of the drum into an electrical energy;

a charging unit that stores the electrical energy generated in the power generation unit or that supplies the electrical energy to each of the valves; and a controller that controls the valves and the driving unit.

9. The laundry treating apparatus of claim 1, further comprising:

a sensing unit that determines a location of clothes inducing an unbalance of the drum;

a controller that controls the valves to allow the fluid supplied to the balancer located in an area of an overall drum area formed by the circumferential surface of the drum so as to increase the weight of the area symmetrically corresponding to the location of the unbalance inducing clothes.

* * * * *